US005955416A

United States Patent [19]

Baillely et al.

[11] Patent Number: 5,955,416

[45] Date of Patent: Sep. 21, 1999

[54] DETERGENT COMPOSITIONS COMPRISING LIPOLYTIC ENZYMES

[75] Inventors: Gerard Marcel Baillely, Newcastle upon Tyne; Barry Thomas Ingram, Tyne & Wear; Christian Leo Marie Vermote, Newcastle upon Tyne, all of United Kingdom

[73] Assignee: The Procter & Gamble Company, Cincinnati, Ohio

[21] Appl. No.: 08/793,224

[22] PCT Filed: Aug. 18, 1995

[86] PCT No.: PCT/US95/09584

§ 371 Date: Feb. 21, 1997

§ 102(e) Date: Feb. 21, 1997

[87] PCT Pub. No.: WO96/06148

PCT Pub. Date: Feb. 29, 1996

[30] Foreign Application Priority Data

Aug. 23, 1994 [EP] European Pat. Off. ..... 94306213

[51] Int. Cl.[6] ..... C11D 1/12; C11D 1/14; C11D 1/75; C11D 3/386

[52] U.S. Cl. ..... 510/357; 510/320; 510/321; 510/356

[58] Field of Search ..... 510/320, 321, 510/356, 357

[56] References Cited

U.S. PATENT DOCUMENTS

| | | | |
|---|---|---|---|
| 3,959,155 | 5/1976 | Montgomery et al. | 252/8.8 |
| 4,470,919 | 9/1984 | Goffinet et al. | 252/548 |
| 5,082,578 | 1/1992 | Langer et al. | 252/102 |
| 5,332,528 | 7/1994 | Pan et al. | 252/548 |

*Primary Examiner*—Michael Lewis
*Assistant Examiner*—Alexander G. Ghyka
*Attorney, Agent, or Firm*—Ian S. Robinson; Brian M. Bolam; Kim William Zerby

[57] ABSTRACT

The present invention relates to detergent compositions comprising lipases, a lipase compatible anionic surfactant system, and a gemini polyhydroxy fatty acid amide. The anionic surfactant system comprises alkyl alkoxylated sulphates having specific ratios of mono-, di- and tri-alkoxylated sulphates. The detergent compositions provide improved greasy soil removal over a wide range of temperatures.

15 Claims, No Drawings

DETERGENT COMPOSITIONS COMPRISING LIPOLYTIC ENZYMES

FIELD OF THE INVENTION

The present invention relates to detergent compositions comprising enzymes, in particular lipases and a lipase compatible anionic surfactant system.

BACKGROUND OF THE INVENTION

One of the most common surfactants currently incorporated in detergent compositions is alkyl benzene sulphonate, particularly linear benzene sulphonate, herein referred to as LAS. The use of alkyl benzene sulphonate usually in combination with other anionic or nonionic surfactants has been found to give particularly effective cleaning performance, especially on greasy and oily stains over a wide range of temperatures and conditions.

It is also highly beneficial to incorporate enzymes into detergent compositions in order to improve overall performance. In particular lipases have been found to provide improvement in the removal of oily stains.

However, it is known from the art (for example EP 373 850) that lipases are particularly sensitive to the other ingredients in the composition in the wash liquor. In particular they are unstable in the presence of surface active agents. This problem is particularly acute in the presence of LAS, which has been shown to significantly reduce the activity of lipase.

Low LAS detergent compositions have been described in the art, for example in EP-A 544 490 and U.S. Pat. No. 4,260,529. However, such detergent compositions often have an low overall level of anionic surfactant which may result in a lower soil suspension capacity and less effective neutralisation of cationic fabric conditioners which may be present in the wash or on the fabric surface.

The art also describes the use of anionic surfactant based detergent compositions, preferably alkyl sulphate, comprising low levels of LAS. For example GB 1 399966 discloses detergent compositions comprising primary alcohol sulphate (PAS) and nonionic surfactants. EP-A 342 917 discloses detergent compositions comprising PAS having a range of chain lengths to improve the cleaning performance at lower temperatures. However, it has been observed that such detergent compositions do exhibit the same cleaning performance as the corresponding LAS compositions.

Therefore, it is an object of the present invention to replace the alkyl benzene sulphonate in surfactant systems with a surfactant which provides excellent cleaning benefits, giving similar overall performance compared to the alkyl benzene sulphonate surfactant systems and in the presence of which lipases are stable in the wash. In addition, another aim of the detergent manufactures is to develop a surfactant system which is readily biodegradable.

It has now been found that these objectives can be achieved by the use of a surfactant system comprising an alkyl alkoxylated sulphate having an average alkoxylation degree of from 0.1 to 10, having specific ratios of alkyl monoalkoxylated sulphate, alkyl dialkoxylated sulphate and alkyl alkoxylates sulphates with 3 or more alkoxy groups per alkyl group. It has been found that said alkyl alkoxy sulphates provide excellent cleaning benefits over a wide range of temperatures and show enhanced lipase stability.

Another advantage of the surfactant system of the present invention are the excellent wetting properties, which is a highly desirable property in detergent compositions.

Furthermore, the surfactant systems of the present invention is particularly efficient in the removal of oily stains.

Detergent compositions comprising alkyl ethoxy sulphates (referred to herein as AES) and lipases have been described in various contexts in the art. For example WO 92/06158 discloses detergent compositions comprising AES with an ethoxylation degree greater than 0, comprising lipases. U.S. patent application Ser. No. 92 05659 discloses detergent compositions comprising AES with a preferred average ethoxylation of from 0.5 to 2. Lipases are mentioned. European Patent Application number 907159.3 discloses granular detergent compositions comprising AES with an ethoxylation degree of 1 to 7. Lipases are disclosed.

JP 4072395 discloses a liquid detergent composition comprising alkyl/alkenyl sulphates having an average ethoxylation of 1 to 7 and enzymes. JP 1161096 discloses a detergent composition comprising alkenyl ether sulphates having from 0.5 to 8 ethoxylation, alkyl sulphates, LAS and lipases.

However, none of the identified art recognise the performance benefits associated with anionic surfactant systems comprising alkyl alkoxylated sulphates having specific ratios of mono-, di- and trialkoxylated sulphates in combination with lipases as in the present invention.

SUMMARY OF THE INVENTION

The present invention is a detergent composition comprising from 1% to 90% of an anionic surfactant system and a lipolytic enzyme having from 50 to 100 000 (LU) lipase units per gram of detergent composition, wherein said anionic surfactant system comprises less than 40% alkyl benzene sulphonate and at least 30% of an alkyl alkoxylated sulphate having an average degree of alkoxylation of from 0.1 to 10 characterised in that the ratio of the combined weight of alkyl monoalkoxylated sulphates and alkyl dialkoxylated sulphates to the total weight of anionic surfactant is at least 0.2 to 1 and the ratio of the combined weight of alkyl monoalkoxylated sulphates and alkyl dialkoxylated sulphates to the total weight of alkyl alkoxylated sulphates having 3 or more alkoxyl groups per alkyl group is 1 or greater.

All weights, ratios and percentages are given as a % weight of the total composition unless otherwise stated.

DETAILED DESCRIPTION OF THE INVENTION

The present invention is a detergent composition comprising a lipolytic enzyme and an anionic surfactant system having improved lipase compatibility.

Thus, an essential component of the present invention is a lipolytic enzyme. The compositions of the present invention comprise a lipolytic enzyme having from 50 to 100 000 (LU) lipase units per gram of detergent composition, preferably from 100 to 10,000 (LU), more preferably from 200 to 1000 (LU) per gram of detergent composition.

Suitable lipases for use herein include those produced by microorganisms of the Pseudomonas group, such as Pseudomonas group, such as *Pseudomonas stutzeri* ATCC 19.154, as disclosed in British Patent 1,372,034, incorporated herein by reference. Suitable lipases include those which show a positive immunological cross-reaction with the antibody of the lipase, produced by the microorganism *Pseudomonas fluorescent* IAM 1057. This lipase and a method for its purification have been described in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P". Such lipases of the present invention should show a positive immunological cross reaction with the Amano-P antibody, using the standard and well-known immunodiffusion procedure according to Ouchterlongy (Acta. Med, Scan., 133, pages 76–79 (1950)). These lipases, and a method for their immunological cross-reaction with Amano-P, are also described in U.S. Pat. No. 4,707,291, Thom et al, issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum*, e.g. *Chromobacter viscosum* var. lipolyticum NRRLB 3673, commercially available from Toyo Jozo Co., Tagata, Japan; and further *Chromobacter viscosum* lipases from US Biochemical Corp., USA and Disoynth Co., The Netherlands, and lipases ex *Pseudomonas gladioli*. Especially suitable Lipase are lipase such as M1 Lipase (Ibis) and Lipolase (Novo).

Another an essential component of the compositions of the present invention is an anionic surfactant system. Said compositions comprise from 1% to 90% of an anionic surfactant system. Said system comprises less than 40% alkyl benzene sulphonates and more than 30%, preferably more than 50%, most preferably more than 70% an alkyl alkoxylated sulphate. The alkoxylated sulphate of the present invention is represented by the formula:

$$R_1\ (C_mH_{2m}O)_nSO_3M$$

wherein $R_1$ is a $C_{10-24}$ , preferably a $C_{12}$–$C_{18}$, most preferably a $C_{14}$–$C_{15}$ linear or branched hydrocarbyl, m is from 1 to 4, preferably 2 to 4, most preferably 2, n is 0 to 10, preferably from 1 to 3, and M is an alkali metal, alkaline earth metal, alkanol amine or ammonium or mixtures thereof.

According to the present invention the alkyl alkoxylated sulphates preferably have an average degree of alkoxylation of from 0.1 to 10, preferably from 0.5 to 3, more preferably from 0.5 to 2, most preferably from 0.5 to 1. The ratio of the combined weight of alkyl monoalkoxy sulphates and alkyl dialkoxy sulphates to the total weight of anionic surfactant is at least 0.2 to 1, preferably 0.25 to 1, most preferably 0.3 to 1. The ratio of the combined weight of alkyl monoalkoxy sulphates and alkyl dialkoxy sulphates to total alkyl alkoxy sulphates having 3 or more alkoxy groups per alkyl group is 1 or greater, preferably 2 to 8, more preferably 4 to 6.

The anionic surfactant system of the present invention may optionally comprise other anionic surfactants known in the art. According to the present invention the compositions comprise from 1% to 90%, preferably from 1% to 70%, most preferably from 5% to 60% of said anionic surfactant system.

Anionic sulphate surfactants

The anionic sulphate surfactant may be any organic sulphate surfactant, other than the alkyl alkoxylated sulphates of the present invention, preferably a $C_{10}$–$C_{16}$ alkyl sulphate. The counterion for the anionic sulphate surfactant component is preferably selected from calcium, sodium, potassium, magnesium, ammonium, or alkanol-ammonium, and mixtures thereof.

Anionic sulphate surfactants suitable for use herein include $C_9$–$C_{17}$ acyl-N-(C1–C4 alkyl) glucamine sulphates, fatty oleyl glycerol sulphates, alkyl phenol ethylene oxide ether sulphates, N-acyl $C_{6-20}$ sarcosinates and sulphates of alkylpolysaccharides such as the sulphates of $C_{10-20}$ alkylpolyglucoside.

Anionic sulphonate surfactant

Anionic sulphonate surfactants suitable for use herein include, for example, the salts (e.g. alkali metal salts) of $C_9$–$C_{20}$ linear alkylbenzene sulphonates, $C_8$–$C_{22}$ primary or secondary alkane sulphonates, $C_8$–$C_{24}$ olefin sulphonates, sulphonated polycarboxylic acids, alkyl glycerol sulphonates, fatty acyl glycerol sulphonates, fatty oleyl glycerol sulphonates, paraffin sulphonates, and any mixtures thereof.

Anionic alkyl ethoxy carboxylate surfactant

Alkyl ethoxy carboxylates suitable for use herein include those with the formula $RO(CH_2CH_2O)x\ CH_2COO—M^+$ wherein R is a $C_{12}$ to $C_{16}$ alkyl group, x ranges from 0 to 10, and the ethoxylate distribution is such that, on a weight basis, the amount of material where x is 0 is less than 20%, preferably less than 15%, most preferably less than 10%, and the amount of material where x is greater than 7, is less than 25%, preferably less than 15%, most preferably less than 10%, the average x is from 2 to 4 when the average R is $C_{13}$ or less, and the average x is from 3 to 6 when the average R is greater than $C_{13}$, and M is a cation, preferably chosen from alkali metal, alkaline earth metal, ammonium mono-, di-, and tri-ethanol-ammonium, most preferably from sodium, potassium, ammonium and mixtures thereof with magnesium ions. The preferred alkyl ethoxy carboxylates are those where R is a $C_{12}$ to $C_{14}$ alkyl group.

Anionic alkyl polyethoxy polycarboxylate surfactant

Alkyl polyethoxy polycarboxylate surfactants suitable for use herein include those having the formula:

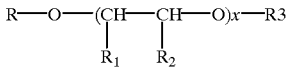

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Anionic secondary soap surfactant

Secondary soap surfactants (aka "alkyl carboxyl surfactants") useful herein are those which contain a carboxyl unit connected to a secondary carbon. It is to be understood herein that the secondary carbon can be in a ring structure, e.g. as in p-octyl benzoic acid, or as in alkyl-substituted cyclohexyl carboxylates. The secondary soap surfactants should contain no ether linkages, no ester linkages and no hydroxyl groups. There should be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the secondary soap surfactants (or their precursor acids) useful herein.

A. A highly preferred class of secondary soaps useful herein comprises the secondary carboxyl materials of the formula $R^3\ CH(R^4)COOM$, wherein $R^3$ is $CH_3(CH_2)x$ and $R^4$ is $CH_3(CH2)y$, wherein y can be O or an integer from 1 to 4, x is an integer from 4 to 10 and the sum of (x+y) is 6–14, preferably 7–13, most preferably 12.

B. Another class of secondary soaps useful herein comprises those carboxyl compounds wherein the carboxyl substituent is on a ring hydrocarbyl unit, i.e., secondary soaps of the formula $R^5$-$R^6$-COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another class of secondary soaps comprises secondary carboxyl compounds of the formula $CH_3(CHR)_k—(CH_2)_m—(CHR)_n—CH(COOM)(CHR)_o—(CH2)_p—(CHR)_q—CH_3$, wherein each R is $C_1$–$C_4$ alkyl, wherein k, n, o, q are integers in the range of 0–8, provided that the total number of carbon atom range (including the carboxylate) is in the range of 10 to 18.

In each of the above formulas A, B and C, the species M can be any suitable, especially water-solubilizing, counterion, e.g., H, alkali metal, alkaline earth metal, ammonium, alkanolammonium, di- and tri-alkanolammonium, and $C_1$–$C_5$ alkyl substituted ammonium. Sodium is convenient, as is diethanolammonium.

Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid, 2-pentyl-1-heptanoic acid and isopentadecanoic acid.

Other anionic surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, alkyl phosphates, isethionates such as the acyl isethionates, N-acyl taurates, acyl alkyl taurines, fatty acid amides of methyl tauride, alkyl succinates and sulphosuccinates, monoesters of sulphosuccinate (especially saturated and unsaturated $C_{12}$–$C_{18}$ monoesters) diesters of sulphosuccinate (especially saturated and unsaturated $C_6$–$C_{14}$ diesters). Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch).

According to the present invention the anionic surfactant system preferably comprises less than 40% linear alkyl benzene sulphonate; preferably less than 20%, more preferably less than 10% linear alkyl benzene sulphonate. Most preferably the anionic surfactant system of the present invention is free of alkyl benzene sulphonates.

According to the present invention the compositions may additionally comprise as optional ingredients other surfactants such cationic, nonionic, zwitterionic and amphoteric surfactants.

Nonionic surfactant

Suitable nonionic detergent surfactants for use herein include nonionic condensates of alkyl phenols, nonionic ethoxylated alcohols, nonionic alkylpolysaccharides and nonionic fatty acid amides. According to the present invention the compositions comprise from 1% to 20%, preferably from 2% to 15% of said nonionic surfactants.

Nonionic condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 12 carbon atoms in either a straight chain or branched chain configuration with the alkylene oxide.

Nonionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol. Most preferred are the condensation products of alcohols having an alkyl group containing from 8 to 14 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14-C15}$ linear alcohol with 9 moles of ethylene oxide), Neodol™ 23-6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), Neodol™ 23-3 (the condensation product of $C_{12}$–$C_{13}$ linear alcohol with 3 moles of ethyene oxide) marketed by Shell Chemical Company, KyroTM EOBN (the condensation product of $C_{11}$–$C_{15}$ alcohol with 9 moles ethylene oxide), marketed by The Procter & Gamble Company, Dobanol 91 marketed by the Shell Chemical Company and Lial 111 marketed by Enichem.

Nonionic EO/PO condensates with propylene glycol

The condensation products of ethylene oxide with a hydrophobic base formed by the condensation of propylene oxide with propylene glycol are suitable for use herein. Examples of compounds of this type include certain of the commercially-available Pluronic™ surfactants, marketed by BASF.

Nonionic EO condensation products with propylene oxide/ethylene diamine adducts

The condensation products of ethylene oxide with the product resulting from the reaction of propylene oxide and ethylenediamine are suitable for use herein. Examples of this type of nonionic surfactant include certain of the commercially available Tetronic™ compounds, marketed by BASF.

Nonionic alkylpolysaccharide surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units. The preferred alkylpolyglycosides have the formula $$R^2O\ (C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7, t is from 0 to 10 and x is from 0 to 10. The glycosyl is preferably derived from glucose.

Nonionic fatty acid amide surfactant

Fatty acid amide surfactants suitable for use herein are those having the formula:

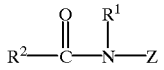

wherein $R_1$ is H or a C1–C4 hydrocarbyl, 2-hydroxy ethyl, 2-hydroxy propyl and $R_2$ is a C5–C31 hydrocarbyl and Z is a polyhydroxyhydrocarbyl having a linear hydrocarbyl chain with at least 3 hydroxy groups directly connected to the chain or an alkoxylated derivative thereof. Preferably R is a methyl, R is a straight chain C11–C15 alkyl or alkenyl such as coconut alkyl or mixtures thereof and Z is derived from a reducing sugar such as glucose, fructose, maltose, lactose in a reductive amination reaction Other polyhydroxy fatty acid amides suitable for use herein are gemini polyhydroxy fatty acid amides having the formula:

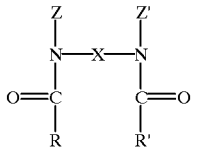

wherein: X is a bridging group having from about 2 to about 200 atoms; Z and Z' are the same or different alcohol-containing moieties having two or more hydroxyl groups (e.g., glycerol, and units derived from reducing sugars such as glucose, maltose and the like), or either one (but not both) of Z or Z' is hydrogen; and R and R' are the same or different hydrocarbyl moieties having from about 1 to about 21 carbon atoms and can be saturated, branched or unsaturated (e.g., oleoyl) and mixtures thereof.

Preferred X groups are selected from substituted or unsubstituted, branched or linear alkyl, ether alkyl, amino alkyl, or amido alkyl moieties having from about 2 to about 15 carbon atoms. Preferred alkyl moieties are unsubstituted, linear alkyl moieties having the formula $—(CH_2)_n—$, wherein n is an integer from 2 to about 15, preferably from 2 to about 10, and most preferably from 2 to about 6; and also unsubstituted, branched alkyl moieties having from 3 to about 15 carbon atoms, preferably from 3 to about 10 carbon atoms, and most preferably from 3 to about 6 carbon atoms. Most preferred are ethylene and propylene (branched or linear) alkyl moieties. Also preferred are unsubstituted, branched or linear ether alkyl moieties having the formula $—R^2—(O—R^2)_m—$, wherein each $R^2$ is independently selected from $C_2$–$C_8$ branched or linear alkyl and/or aryl moieties (preferably ethyl, propyl or combinations thereof) and m is an integer from 1 to about 5. X may also be unsubstituted, branched or linear amino and/or amido alkyl moieties having the formula $—R^2—(N(R^3)—R^2)_m—$, wherein each $R^2$ is independently selected from $C_2$–$C_8$ branched or linear alkyl and/or aryl moieties (preferably ethyl, propyl or combinations thereof), m is an integer from 1 to about 5, and $R^3$ is selected from hydrogen, $C_1$–C5 alkyl, and $—C(O)R^4—$, wherein $R^4$ is $C_1$–$C_{21}$ alkyl, including —C(O)R. The X moiety may be derived from commercially available amine compounds such as, for example, Jeffamines$_R$ (supplied by Texaco) such as JED600, JEDR148, JEDR192, JED230, JED2000, J-D230 and J-D400.

Preferred X moieties therefore include: $—(CH_2)_2—$, $—(CH_2)_3—$, $—(CH_2)_4—$, $—(CH_2)_5—$, $—(CH_2)_6—$, $—CH_2CH(CH_3)(CH_2)_3—$, $—(CH_2)_2—O—(CH_2)_2—$, $—(CH_2)_3—O—(CH_2)_3—$, $—(CH_2)_2—O—(CH_2)_3—$, $—(CH_2)_2—O—(CH_2)_2—O—(CH_2)_2—$, $—(CH_2)_3—O—(CH_2)_2—O—(CH_2)_3—$, $—(CH_2)_2—O—(CH_2)_3—O—(CH_2)_2—$, $—(CH_2)_2—NH—(CH_2)_2—$, $—(CH_2)_3—NH—(CH_2)_3—$, $—(CH_2)_2—NH—(CH_2)_3—$, $—(CH_2)_2—N(C(O)R)—(CH_2)_2—$, $—(CH_2)_3—N(C(O)R)—(CH_2)_3—$, $—(CH_2)_2—N(C(O)R)—(CH_2)_3—$, $—(CH_2)_2—NH(C_6H_4)NH—(CH_2)_2—$, $—(CH_2)_3—NH(C_6H_4)NH—(CH_2)_3—$, $—(CH_2)_2—NHCH_2(C_6H_4)CH_2NH—(CH_2)_2—$, $—(CH_2)_3—NHCH_2(C_6H_4)CH_2NH—(CH_2)_3—$, etc.

Preferred Z and Z' groups are independently selected from polyhydroxyhydrocarbyl moieties having a linear hydrocarbyl chain with at least 2 hydroxyls (in the case of glycerol) or at least 3 hydroxyls (in the case of other sugars) directly connected to the chain, or an alkoxylated derivative (preferably ethoxylated or propoxylated) thereof. Z and Z' preferably will be derived from a reducing sugar, more preferably Z and/or Z' is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z and Z'. It should be understood that it is by no means intended to exclude other suitable raw materials. Z and/or Z' preferably will be selected from the group consisting of $—CH_2—(CHOH)—_p—CH_2OH$, $—CH(CH_2OH)—(CHOH)_p\text{-}1—CH_2OH$, $—CH_2—(CHOH)_2(CHOR^1)(CHOH)—CH_2OH$, where p is an integer from 1 to 5, inclusive, and $R^1$ is H or a cyclic mono- or polysaccharide, and alkoxylated derivatives thereof. Most preferred are glycityls wherein p is 4, particularly $—CH_2—(CHOH)_4—CH_2OH$.

Preferred R and R' groups are independently selected from $C_3$–C21 hydrocarbyl moieties, preferably straight or branched chain $C_3$–$C_{13}$ alkyl or alkenyl, more preferably straight chain $C_5$–$C_{11}$ alkyl or alkenyl, most preferably straight chain $C_5$–$C_9$ alkyl or alkenyl, or mixtures thereof. R— CO—N< and/or R'—CO—N< can be, for example, cocamide, stearamide, oleamide, lauramide, myristamide, capricamide, palmitamide, tallowamide, etc.

Examples of such compounds therefore include, but are not limited to: $CH_3(CH_2)_6C(O)N[CH_2(CHOH)_4CH_2OH]—(CH_2)_2—[CH_2(CHOH)_4CH_2OH]NC(O)(CH_2)_6CH_3$; $CH_3(CH_2)_8C(O)N[CH_2(CHOH)_4CH_2OH]—(CH_2)_2—[CH_2(CHOH)_4CH_2OH]NC(O)(CH_2)_8CH_3$; $CH_3(CH_2)_{10}C(O)N[CH_2(CHOH)_4CH_2OH]—(CH_2)_2—[CH_2(CHOH)_4CH_2OH]NC(O)(CH_2)_{10}CH3$; $CH_3(CH_2)_8C(O)N[CH_2(CHOH)_4CH_2OH]—(CH_2)_2—O—(CH_2)_2—O—(CH_2)_2—[CH_2(CHOH)_4CH_2OH]NC(O)(CH_2)_8CH_3$; $CH_3(CH_2)_8C(O)N$ $[CH_2(CHOH)_4CH_2OH]—CH_2CH(CH_3)(CH_2)_3—[CH_2(CHOH)_4CH_2OH]NC(O)(CH_2)_8CH_3$; $CH_3(CH_2)_8C(O)N[CH_2(CHOH)_4CH_2OH]—(CH_2)_3—O—(CH_2)_2—O—(CH_2)_3—[CH_2(CHOH)_4CH_2OH]NC(O)(CH_2)_8CH_3$; $CH_3(CH_2)_3CH(CH_2CH_3)C(O)N[CH_2(CHOH)_4CH_2OH]—(CH_2)_2—[CH_2(CHOH)_4CH_2OH]NC(O)CH(CH_2CH_3)(CH_2)_3CH_3$; $CH_3(CH_2)_6C(O)N[CH_2(CHOH)_4CH_2OH]—(CH_2)_3—O—(CH_2)_2—O—(CH_2)_3—[CH_2(CHOH)_4CH_2OH]NC(O)(CH_2)_6CH_3$; $CH_3(CH_2)_4C(O)N[CH_2(CHOH)_4CH_2OH]—(CH_2)_3—O—(CH_2)_2—O—(CH_2)_3—[CH_2(CHOH)_4CH_2OH]NC(O)(CH_2)_8CH_3$; $C_6H_5C(O)N[CH_2(CHOH)_4CH_2OH]—(CH_2)_3—O—(CH_2)_2—O—(CH_2)_3—[CH_2(CHOH)_4CH_2OH]NC(O)C_6H_5$; $CH_3(CH_2)_4C(O)N[CH_2(CHOH)_4CH_2OH]—(CH_2)_2—[CH_2(CHOH)_4CH_2OH]NC(O)(CH_2)_8CH_3$.

These compounds can be readily synthesized from the following disugar diamines: $HN[CH_2(CHOH)_4CH_2OH]—(CH_2)_2—[CH_2(CHOH)_4CH_2OH]NH$; $HN[CH_2(CHOH)_4CH_2OH]—CH_2CH(CH_3)(CH_2)_3—[CH_2(CHOH)_4CH_2OH]NH$; $HN[CH_2(CHOH)_4CH_2OH]—(CH_2)_2—O—(CH_2)_2—O—(CH_2)_2—[CH_2(CHOH)_4CH_2OH]NH$; $HN[CH_2(CHOH)_4CH_2OH]—(CH_2)_3—O—(CH_2)_2—O—(CH_2)_3—[CH_2(CHOH)_4CH_2OH]NH$; and $HN[CH_2(CHOH)_4CH_2OH]—(CH_2)_3—[CH_2(CHOH)_4CH_2OH]NH$.

Amphoteric surfactant

Suitable amphoteric surfactants for use herein include the alkyl amphocarboxylic acids of the formula:

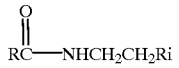

wherein R is a $C_8$–$C_{18}$ alkyl group, and $R_i$ is of the general formula:

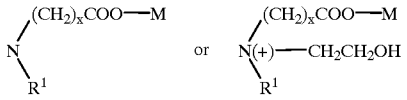

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium and mixtures thereof with magnesium ions. The preferred R alkyl chain length is a $C_{10}$ to $C_{14}$ alkyl group. A preferred amphocarboxylic acid is produced from fatty imidazolines wherein the dicarboxylic acid functionality of the amphodicarboxylic acid is diacetic acid and/or dipropionic acid. A suitable example of an alkyl amphodicarboxylic acid for use herein in the amphoteric surfactant Miranol(TM) C2M Conc. manufactured by Miranol, Inc., Dayton, N.J.

Amine oxide surfactant

According to the present invention in amine oxides useful as amphoteric surfactants may be used herein. Amine oxides suitable for use herein have the formula:

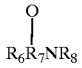

wherein $R_6$ is selected from an alkyl, hydroxyalkyl, acylamidopropoyl and alkyl phenyl group, or mixtures thereof, containing from 6 to 18 carbon atoms, preferably 12 to 14 carbon atoms; and $R_7$ and $R_8$ are independently $C_{1-3}$ alkyl or $C_{2-3}$ hydyroxyalkyl groups, or a polyethylene oxide group containing from 1 to 3, preferable 1, ethylene oxide groups. These amine oxide surfactants in particular include $C_{10}$–$C_{14}$ alkyl dimethyl amine oxides and $C_6$–$C_{12}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide and dodecylamidopropyl dimethylamine oxide. Preferred are $C_{12}$–$C_{14}$ alkyl dimethylamine oxides and mixtures thereof.

Zwitterionic surfactant

Zwitterionic surfactants can also be incorporated into the detergent compositions herein.

Betaine surfactant

According to the present invention the compositions may thus comprise betaines. The betaines useful as zwitterionic surfactants, in the present invention are those compounds having the formula $R(R^1)_2N^+R^2COO^-$: wherein R is a $C_6$–C18 hydrocarbyl group, preferably a $C_{10}$–$C_{16}$ alkyl group or $C_{10-16}$ acylamido alkyl group, each $R^1$ is typically $C_1$–$C_3$ alkyl, preferably methyl, and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines.

The complex betaines suitable for use herein have the formula:

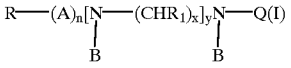

wherein R is a hydrocarbon group having from 7 to 22 carbon atoms, preferably 12 to 14 carbon atoms, A is the group (C(O)), n is 0 or 1, $R_1$ is hydrogen or a lower alkyl group, x is 2 or 3, y is an integer of 0 to 4, Q is the group $—R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

According to the present invention the composition may comprise from 0% to 10%, preferably from 0% to 5% of said betaines.

Sultaines

The sultaines useful in the present invention are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. The zwitterionics herein above may also be present in small quantities so as to deliver suds enhancing benefits to the compositions.

Cationic surfactant

Cationic detersive surfactants suitable for use herein are those having one long chain hydrocarbyl group. Examples of such cationic surfactants include the ammonium surfactants such as alkyldimethylammonium halogenides and surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000 and hydrogen when y is not 0; $R^5$ is the same as $R^4$ or is an alkyl chain wherein the total number of carbon atoms of $R^2$ plus $R^5$ is not more than about 18; each y is from about 0 to about 10 and the sum of the y values is from 0 to about 15; and X is any compatible anion.

Preferred cationic surfactants are the water soluble quaternary ammonium compounds useful in the present composition have the formula:

$$R_1R_2R_3R_4N^+X^-$$

wherein $R_1$ is a $C_8$–$C_{16}$ alkyl, each of $R_2$ $R_3$ and $R_4$ is independently $C_1$–$C_4$ alkyl, $C_1$–$C_4$ hydroxy alkyl, benzyl and $(C_2H_4O)_xH$ where x has a value of from 1 to 5 and X is an anion. Not more than one of the $R_2$, $R_3$ or $R_4$ should be benzyl.

The preferred alkyl chain length for $R_1$ is from $C_{12}$–$C_{15}$, particularly where the alkyl group is a mixture of chain lengths derived from coconut or palm kernel fat or is derived from synthetically by olefin build up or OXO alcohols synthesis. Preferred groups for the $R_2R_3$ and $R_4$ are methyl and hydroxyethyl groups and the anion X may be selected from halide, methosulphate, acetate and phosphate ions.

Examples of suitable quaternary ammonium compounds for use herein are:

coconut trimethyl ammonium chloride or bromide; coconut methyl dihydroxyethyl ammonium chloride or bromide; decyl trimethyl ammonium chloride; decyl dimethyl hydroxyethyl ammonium chloride or bromide; $C_{12}$–$C_{15}$ dimethyl hydroxyethyl ammonium chloride or bromide; coconut dimethyl hydroxyethyl ammonium chloride or bromide; myristyl trimethyl ammonium methyl sulphate; lauryl dimethyl benzyl ammonium chloride or bromide; lauryl dimethyl (ethoxy)$_4$ ammonium chloride or bromide and choline esters.

Other cationic surfactants useful herein are also described in U.S. Pat. No. 4,228,044. When included therein the laundry detergent compositions of the present invention typically comprise from 0.5% to about 5% by weight of said cationic surfactants.

According to the present invention the compositions may also comprise optional ingredients such as builders, enzymes, antiredeposition agents, polymeric soil release agents, chelating agents, dispersing agents and suds supressors or enhancers.

Enzymes

In addition to lipase the detergent composition of the present invention may comprise additional enzymes such as proteases, amylases, cellulases, and peroxidases, as well as mixtures thereof. Other types of enzymes may also be included. They may be of any suitable origin, such as vegetable, animal, bacterial, fungal and yeast origin. However, their choice is also governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers

The optional enzymes incorporated in the detergent compositions of the present invention are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturallyoccurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Polymeric Soil Release Agent

According to the present invention the detergent compositions may comprise a polymeric soil release agent. Polymeric soil release agents are characterised by having a hydrophobic and hydrophilic segments.

Polymeric soil release agents for use herein have a) 1 or more nonionic hydrophile components consisting of (i) polyoxyethylene segments with a degree of polymerisation of at least 2, or (ii) oxypropylene or polyoxypropylene segments with a polymerisation degree of 2 to 10, wherein said hydrophile segment does not encompass any oxypropylene unit unless bonded to adjacent moieties at each end by ether linkages, or (iii) a mixture of oxyalkylene units comprising oxyethylene and from 1 to 30 oxyoxypropylene units, or b) 1 or more hydrophobe components comprising (i) C3 oxyalkylene terephthalate segments, wherein, if said hydrophobe components also comprise oxyethylene terephthalate, the ratio of oxyethylene terethphalate:C3 oxyalkylene terephthalate units is about 2:1 or lower, (ii) C4–C6 alkylene or oxy C4–C6 alkylene segments, or mixtures therein, (iii) poly (vinyl ester segments, preferably poly (vinyl acetate), having a degree of polymerisation of at least 2, or (iv) C1–C4 alkyl ether or C4 hydroxyalkyl ether substituents or mixtures thereof, wherein said subsituents are present in the form of C1–C4 alkyl ether or C4 hydroxyalkyl ether cellulose derivatives, or mixtures thereof and such cellulose derivatives are amphiphilic, whereby they have a sufficient level of C1–C4 alkyl ether and/or C4 hydroxyalkyl ether units to deposit upon conventional polyester synthetic fibre surfaces and retain a sufficient level of hydroxyls to increase fibre surface hydrophilicity, or a combination of (a) and (b).

Typically the polyoxyethylene segments of (a)(i) have a degree of polymerisation of 2 to 200, preferably 3 to 150, most preferably 6 to 100. Suitable oxy C4–C6 alkylene hydrophobe segments include end caps of polymeric soil release agents such as $MO_3S(CH)_nOCH_2CH_2O$—, where M is sodium and n is an integer from 4 to 6.

Soil release agents characterised by poly(vinyl ester) hydrophobe segments include graft copolymers of poly (vinyl ester), e.g. C1–C6 vinyl esters, preferably polyvinyl acetate) grafted onto polyalkylene oxide backbones, such as polyethylene oxide backbones. Commercially available materials of this kind include Sokalan marketed by BASF.

Chelating Agents

The compositions of the present invention may optionally contain one or more chelating agents selected from the group consisting of amino carboxylates, amino phosphonates, polyfunctionally-substituted aromatic chelating agents and mixtures thereof. It is believed that the benefit of these materials is due in part to their exceptional ability to remove iron and manganese ions from washing solutions by the formation of soluble chelates.

Amino carboxylates useful as chelating agents include ethylenediaminetetraacetates, N-hydroxyethylenediaminetriacetates, nitrilo-acetates, ethylenediamine tetraproprionates, triethylenetetraaminehexaacetates, diethylenetriaminepentaacetates and ethanoldiglycines, alkali metal ammonium and substitute ammonium salts therein and mixtures therein.

Amino phosphonates are also suitable for use as chelating agents in the compositions of the present invention, preferably in the presence of low levels of total phosphorus in the detergent compositions. Suitable phosphonates include ethylenediaminetetrakis (methylenephosphonates), nitrilotris (methylenephosphonates) and diethylenetriaminepentakis (methylenephosphonates) as DEQUEST ("DTPMP"). Preferably these amino phosphonates do not contain alkyl or alkenyl groups with more than about 6 carbon atoms. HEDP, 1-hydroxyethane diphosphonate is also suitable and preferably combined with aminophosphonates or amino carboxylates for use herein.

Polyfunctionally-substituted aromatic chelating agents are also useful in the compositions herein. See U.S. Pat. No. 3,812,044. Preferred compounds of this type in acid form are dihydroxydisuphobenzenes such as 1,2-dihydroxy-3,5-disulphobenzene.

A preferred biodegradable chelator for use herein is ethylenediamine disuccinate ("EDDS") especially the s,s form as described in U.S. Pat. No. 4,704,233.

Polymeric Dispersing Agents

Polymeric dispersing agents are suitable detergent optional ingredients in the detergent compositions of the present invention. Suitable polymeric dispersing agents include for example polymeric polycarboxylates and polyethylene glycols. It is believed that the polymeric dispersing agents enhance overall detergent builder performance when used in combination with other builders by crystal growth inhibition, particulate soil release peptitization and anti-redeposition.

Polymeric polycarboxylate materials can be prepared by polymerising or copolymerising suitable unsaturated monomers, preferably in their acid form. Unsaturated monomeric acids that can be polymerised to form suitable polymeric polycarboxylates include acrylic acid aconitic acid, mesaconic acid, citraconic acid and methylenemalonic acid. The presence in the polymeric polycarboxylates herein of monomeric segments containing no carboxylate radicals such as vinylmethyl ether styrene, ethylene etc. is suitable provided that such segments do not constitute more than about 40% by weight.

Particularly suitable polymeric polycarboxylates can be derived from acrylic acid. Such acrylic acid-based polymers which are useful herein are the water soluble salts of polymerised acrylic acid. The average molecular weight of such polymers in the acid form preferably ranges from about 2000 to 10000, more preferably from about 4000 to 7000 and most preferably from about 4000 to 5000. Water soluble salts of such acrylic acid polymers can include for example the alkali metal, ammonium and substituted ammonium salts. Use of polyacrylates of this type in detergent compositions has been described for example in U.S. Pat. No. 3,308,067.

Acrylic maleic based copolymers may also be used as a preferred component of the dispersing/antiredeposition agent. Such materials include the water soluble salts of copolymers of acrylic acid and maleic acid. The average molecular weight of such copolymers in the acid form preferably ranges from about 2000 to 100000, more preferably from 5000 to 75000, most preferably from 7000 to 70000. The ratio of acrylate to maleate segments in such copolymers will generally range from about 10:1 to 2:1. water soluble salts such of such acrylic acid/maleic acid copolymers can include for example the alkali metal, ammonium, and substituted ammonium salts. Suitable acrylate/maleate copolymers of this type are known materials described in European Patent Application Number 66915.

Another polymeric material which can be included is polyethylene glycol (PEG). PEG can exhibit dispersing agent performance as well as act as a clay soil removal/antireposition agent. Typical molecular weight ranges for these purposes range from about 500 to 100000, preferably from about 1000 to 50000, more preferably from about 1500 to 10000.

Polyaspartate and polyglutamate dispersing agents (mol. wt. about 10000) may also be used especially in conjunction with zeolite builders.

Suds suppressor

Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Bleaching agents

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein, the bleaches are selected fro their compatibility with lipase.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used. Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, filed Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl)oxybenzenesulfonate, (6-nonanamidocaproyl)-oxybenzenesulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

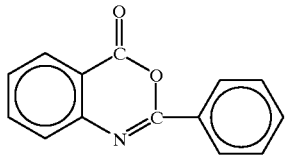

Still another class of preferred bleach activators includes the acyl lactam activators, especially acyl caprolactams and acyl valerolactams of the formulae:

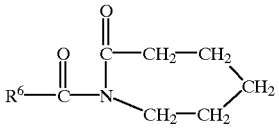

,

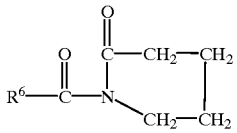

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2\text{-}(ClO_4)_2$, $Mn^{IV}_4(u\text{-}O)_6(1,4,7\text{-triazacyclononane})_4(ClO_4)_4$, $Mn^{III}Mn^{IV}_4\text{-}(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos: 4,728,455; 5,284,944; 5,246,612; 5,256,779; 5,280,117; 5,274,147; 5,153,161; 5,227,084;

In its broadest aspect the present invention relates to detergent compositions. These compositions may be in any form such as powder, granules, liquid, paste, gel or solid bar. Each particular embodiment of the present invention may additionally comprise optional ingredients such as soil suspending agents, abrasives, bactericides, tarnish inhibitors, colouring agents, corrosion inhibitors and perfumes, which are known in the art and are required to formulate the particular composition.

The detergent compositions described herein are for use in cleaning purposes, principally for fabric treatment. However, the compositions may also find utility for both manual and automatic dishwashing purposes.

EXAMPLES

The invention will now be described in more detailed by the following non-limiting examples.

EXAMPLES 1–16

I. The stability of Lipase (i.e. enzyme activity versus time) was determined in a wash solution containing 1000 ppm anionic surfactant, 500 ppm zeolite, 500 ppm SKS-6,500 ppm carbonate, 100 ppm polydimethylsiloxane, Lipase (3.0 LU/mL). The water hardness of the wash solution was 5.0 dH (Clark). The temperature of the wash solution was 40° C. Lipase activity was measured at 25° C. versus time using a standard Analytical method (pH stat). The influence of different anionic surfactant on lipase stability was investigated:

Wash solutions in example 1, contains alkyl ethoxy sulphate salt, according to the present invention, while examples 2 and 3 do not.

Example 1 wash solution A contains an alkyl ethoxylated sulphonate with a $C_{14}$–$C_{15}$ chain-length, an average of 0.6 moles ethylene oxide per mole of surfactant, containing 23% $AE_1S$, 10% $AE_2S$ and 5% $AE_xS$ (with $x \geqq 3.0$).

Example 2 solution B contains $C_{11}$–$C_{15}$ Alkyl Sulphate as anionic surfactant Example 3 solution C contains $C_{16}$ secondary Alcohol Sulphate as anionic surfactant Lipase activity versus time

| time (min) | A | B | C |
|---|---|---|---|
| 0 | 100.0 | 100.0 | 100.0 |
| 10 | 86.4 | 70.0 | 71.6 |
| 20 | 76.8 | 56.4 | 46.2 |
| 30 | 71.0 | 48.1 | 40.9 |
| 40 | 61.6 | 44.7 | 32.2 |
| 50 | 58.4 | 38.2 | 23.7 |
| 60 | 53.9 | 34.2 | 20.7 |

II. The stability of lipase was also determined in hard water [25.0 dH (Clark)]. The temperature of the wash solution was 45° C. The composition of the wash formulation was identical to the one described above. The lipase activity was measured at 25° C. versus time using a standard Analytical method (pH stat). The influence of different anionic surfactant lipase stability was investigated:

Wash solution in example 4 contains alkyl ethoxy sulphate salt of the present invention, while examples 5 and 6 do not.

Example wash solution D contains an alkyl ethoxylated sulphonate with a $C_{14}$–$C_{15}$ chain-length, an average of 0.6 moles ethylene oxide per mole of surfactant, containing 23% $AE_1S$, 10% $AE_2S$ and 5% $AE_xS$ (with $x \geqq 3.0$).

Example 5 wash solution E contains $C_{14}$–$C_{15}$ Alkyl Sulphate as anionic surfactant.

Example 6 wash solution F contains $C_{16}$ secondary Alcohol Sulphate as anionic surfactant Lipase activity versus time

| time (min) | D | E | F |
|---|---|---|---|
| 0 | 100.0 | 100.0 | 100.0 |
| 10 | 86.7 | 81.3 | 74.4 |
| 20 | 80.5 | 62.0 | 62.8 |
| 30 | 74.5 | 47.8 | 46.5 |
| 40 | 67.0 | 41.3 | 39.5 |
| 50 | 64.0 | 34.2 | 34.9 |
| 60 | 61.4 | 31.8 | 16.3 |

Wash solutions A and D containing alkyl ethoxy sulphates, are more lipase compatible than wash solutions B, C, E, F at the same water hardness.

Examples 7–10

The following granular detergent compositions were prepared by mixing the listed ingredients in the amounts specified.

| | 7 | 8 | 9 | 10 |
|---|---|---|---|---|
| Linear Alkyl Sulphate | — | 3.6 | — | — |
| Alkyl Ethoxylated Sulphate AExS | | | | |
| with x = 0 | 6.6 | 0.5 | 5.4 | 7.2 |
| with x = 1 | 2.5 | 3.8 | 2.1 | 2.8 |
| with x = 2 | 1.1 | 0.5 | 1.8 | 1.2 |
| with x = 3 | 0.8 | 0.8 | 0.6 | 0.8 |
| Alkyl Ethoxylate | 5 | 6 | 4 | 4 |
| Alkyl-N-methyl Glucosamide | 2 | 3 | — | — |
| Alkyl tri-methyl ammonium chloride | — | — | 2 | — |
| Perborate | — | — | — | 7 |

-continued

| | 7 | 8 | 9 | 10 |
|---|---|---|---|---|
| Percarbonate | 22 | — | 17 | — |
| N,N,N,N-tetra acetyl ethylene diamine | 6 | — | 5 | 2 |
| S,S-Ethylene diamine-di-succinic acid | 0.4 | 0.7 | 0.2 | 0.2 |
| Enzymes (e.g. lipase, protease, cellulase, amylase) | 1.0 | 0.7 | 0.8 | 1.2 |
| Aluminosilicate (zeolite A) | 14 | 15 | 10 | 8 |
| Layered silicate/citric acid | 12 | — | — | — |
| Sodium citrate | 5 | — | — | — |
| sodium carbonate | 8 | 8 | 6 | 6 |
| sodium silicate | — | — | — | 2 |
| sulphate | — | — | — | 11 |
| sodium maleic & acrylic acid copolymer | 5 | 4 | 3 | 3 |
| Sodium carboxymethyl cellulose | 0.4 | 0.3 | 0.3 | 0.3 |
| Soil release polymer | 0.3 | 0.2 | 0.3 | 0.3 |
| polyvinyl-N-oxide | 0.03 | 0.2 | — | — |
| PEG | — | 0.5 | — | — |
| brighteners, suds suppressors | 0.3 | — | 0.2 | 0.2 |

Example 11

A liquid detergent composition according to the present invention was prepared containing the following ingredients:

| % by weight of the detergent composition | |
|---|---|
| AExS with | |
| x = 0 | 15.6 |
| x = 1 | 6.0 |
| x = 2 | 2.6 |
| x = 3 | 1.8 |
| $C_{12}$–$C_{14}$ N-methyl glucamide | 6.5 |
| $C_{12}$–$C_{14}$ fatty alcohol ethoxylate | 6.5 |
| $C_{12}$–$C_{16}$ fatty acid | 7 |
| Citric acid anhydrous | 6.0 |
| Diethylene triamine penta methylene phosphonic acid | 1.0 |
| Monoethanolamine | 13.2 |
| Propanediol | 12.7 |
| Ethanol | 1.8 |
| Enzymes (e.g. lipase, protease, cellulase) | 0.9 |
| Terephthalate-based polymer | 0.5 |
| Boric acid | 2.4 |
| Minors and water | |

What is claimed is:

1. A detergent composition comprising from 1% to 90%, by weight, of an anionic surfactant system, from about 0.25% to about 10%, by weight, of a borate compound selected from the group consisting of boric oxide, borax, alkali metal borates, phenylboronic acid, butane boronic acid, p-bromo phenylboronic acid and mixtures thereof, a lipolytic enzyme having from 50 to 100,000 lipase units per gram of detergent composition and a gemini polyhydroxy fatty acid amide according to the formula:

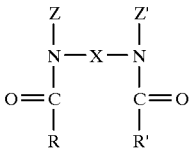

wherein X is selected from the group consisting of alkyl, ether alkyl, amino alkyl, and amido alkyl moieties having from 2 to 15 carbon atoms; Z and Z' are each independently selected from the group consisting of alcohol-containing moieties having two or more hydroxyl groups, with the proviso that one of Z or Z' may be hydrogen; and R and R' are each independently selected from the group consisting of hydrocarbon moieties having from 1 to 13 carbon atoms;

wherein said anionic surfactant system comprises less than 40%, by weight of the surfactant system, alkyl benzene sulphonate and at least 30%, by weight of the surfactant system, of an alkyl alkoxylated sulphate having an average degree of alkoxylation of from 0.1 to 10 and wherein the ratio of the combined weight of alkyl monoalkoxylated sulphates and alkyl dialkoxylated sulphates to the total weight of anionic surfactant is at least 0.2:1 and the ratio of the combined weight of alkyl monoalkoxylated sulphates and alkyl dialkoxylated sulphates to the total weight of alkyl alkoxylated sulphates having 3 or more alkoxy groups per alkyl group is 1:1 or greater.

2. A detergent composition according claim 1, wherein said alkyl alkoxylated sulphate has an average degree of alkoxylation of from 0.5 to 3.

3. A detergent composition according to claim 1, wherein said ratio of the combined weight of alkyl monoalkoxylated sulphates and alkyl dialkoxylated sulphates to the total weight of anionic surfactant is 0.25:1 to 1:11, and said ratio of the combined weight of alkyl monoalkoxylated sulphates and alkyl dialkoxylated sulphates to the total weight of alkyl alkoxylated sulphates having 3 or more alkoxy groups is 2:1 to 8:1.

4. A detergent composition according to claim 1, wherein said alkyl alkoxylated sulphates are according to the formula $R_1(C_mH_{2m}O)_nSO_3M$, wherein $R_1$ is a $C_{12}$–$C_{18}$, linear or branched hydrocarbyl, m is from 1 to 4, n is from 0.1 to 10 and M is an alkali metal, an alkaline earth metal, alkanol amine or ammonium and mixtures thereof.

5. A detergent composition according to claim 1, wherein the anionic surfactant system further comprises a surfactant selected from the group consisting of:

a. alkyl polyethoxy polycarboxylates having the formula:

$$R—O—(CHR^1—CHR^2—O)_x—R^3$$

wherein R is a $C_{6-18}$ alkyl group; x is from 1 to 25; $R^1$ and $R^2$ are independently selected from the group consisting of hydrogen, methyl acid radical, succinic acid radical, hydroxysuccinic acid radical and mixtures thereof, and wherein at least one $R^1$ or $R^2$ is a succinic acid radical or hydroxysuccinic acid radical; and $R^3$ is selected from the group consisting of hydrogen, and $C_{1-8}$ hydrocarbons;

b. surfactants having the formula:

$$R^4CH(R^5)COOM$$

wherein $R^4$ is $CH_3(CH_2)_x$ and $R^5$ is $CH_3(CH_2)_y$ wherein x is an integer from 4 to 10; y is 0 or an integer from 1 to 4, and the sum of (x+y) is from 6 to 14; and M is a water-solubilizing counterion;

c. surfactants having the formula:

$$R^6—R^7—COOM$$

wherein $R^6$ is a $C_{7-10}$ alkyl or a $C_{7-10}$ alkenyl; and $R^7$ is benzene, cyclopentane or cyclohexane; and M is a water-solubilizing counterion; and d. mixtures thereof.

6. A detergent composition according to claim 1, further comprising an amido bleach activator having the formula:

$R^9N(R^{10})C(O)R^{11}C(O)L$ or $R^9C(O)N(R^{10})R^{11}C(O)L$ wherein $R^9$ is an alkyl group containing from about 6 to about 12 carbon atoms; $R^{10}$ is H, aryl or an alkyl group containing from 1 to about 10 carbon atoms; and $R^{11}$ is an alkylene group containing from 1 to about 6 carbon atoms.

7. A detergent composition comprising:

a. lipolytic enzyme in an amount sufficient to provide from 50 to 100,000 lipase units per gram of detergent composition;

b. from 1% to 90%, by weight, of an anionic surfactant system comprising an alkyl monoalkoxylated sulphate, an alkyl dialkoxylated sulphate, and an alkyl alkoxylated sulphate having at least 3 alkoxy groups per alkyl group; and c. a gemini polyhydroxy fatty acid amide according to the formula:

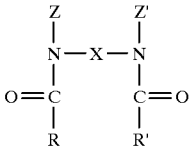

wherein X is selected from the group consisting of alkyl, ether alkyl, amino alkyl, and amido alkyl moieties having from 2 to 15 carbon atoms: Z and Z' are each independently selected from the group consisting of alcohol-containing moieties having two or more hydroxyl groups, with the proviso that one of Z or Z' may be hydrogen; and R and R' are each independently selected from the group consisting of hydrocarbon moieties having from 1 to 13 carbon atoms;

wherein the ratio of the combined weight of alkyl monoalkoxy sulphate and alkyl dialkoxy sulphate to the total weight of alkyl alkoxy sulphates having 3 or more alkoxy groups is at least 1:1 and the ratio of the combined weight of the alkyl monoalkoxy sulphate and the alkyl dialkoxy sulphate to the total weight of anionic surfactant is from 0.2:1 to 1:1.

8. A detergent composition according to claim 7, further comprising from about 1% to about 30%, by weight, of a bleaching agent.

9. A detergent composition according to claim 8, comprising an amido bleach activator having the formula:

$R^9N(R^{10})C(O)R^{11}C(O)L$ or $R^9C(O)N(R^{10})R^{11}C(O)L$ wherein $R^9$ is an alkyl group containing from about 6 to about 12 carbon atoms; $R^{10}$ is H, aryl or an alkyl group containing from 1 to about 10 carbon atoms; and $R^{11}$ is an alkylene group containing from 1 to about 6 carbon atoms.

10. A detergent composition according to claim 2, wherein the anionic surfactant system is free of linear alkyl benzene sulphonates.

11. A detergent composition according to claim 7, further comprising from about 0.25% to about 10%, by weight, of a borate compound selected from the group consisting of boric acid, boric oxide, borax alkali metal borates, phenylboronic acid, butane boronic acid, p-bromo phenylboronic acid, and mixtures thereof.

12. A detergent composition according to claim 7, further comprising from about 0.25% to about 10%, by weight, of a borate compound selected from the group consisting of boric acid, boric oxide, borax alkali metal borates, phenylboronic acid, butane boronic acid, p-bromo phenylboronic acid, and mixtures thereof.

13. A detergent composition according to claim 7, wherein the detergent composition is in the form of a liquid and comprises from about 1 to about 30 millimoles of calcium ions per liter of detergent composition.

14. A detergent composition according to claim 7, wherein the ratio of the combined weight of alkyl monoalkoxylated sulphate and alkyl dialkoxylated sulphate to the total weight of alkyl alkoxylated sulphates having 3 or more alkoxy groups is 2:1 to 8:1.

15. A detergent composition according to claim 8, comprising:

a. the lipolytic enzyme in an amount sufficient to provide from 200 to 1000 lipase units per gram of detergent composition;

b. 5% to 60%, by weight of the detergent composition, of the anionic surfactant system;

c. 2% to 15%, by weight of the detergent composition, of a nonionic surfactant system comprising a condensation product of an alcohol having an alkyl group containing from 8 to 14 carbon atoms with from about 6 to about 10 moles of ethylene oxide per mole of alcohol; and d. an additional enzyme selected from the group consisting of proteases, amylases, cellulases, peroxidases and mixtures thereof.

* * * * *